US012241186B2

(12) United States Patent
Hendry et al.

(10) Patent No.: US 12,241,186 B2
(45) Date of Patent: Mar. 4, 2025

(54) DOUBLE-KNIT TEXTILE WITH TEXTURIZED INLAY YARNS

(71) Applicants: NIKE, Inc., Beaverton, OR (US); Fujian Huafeng New Material Co., Ltd., Putian (CN)

(72) Inventors: Ricky Hendry, Portland, OR (US); Alexandra Gully, Portland, OR (US); Raj Mistry, Portland, OR (US); Fay Ou-Yang, Portland, OR (US); Karl Pinfold, Portland, OR (US); Kamran Daneshvar, Portland, OR (US); Huayu Fang, Putian (CN); Yishu Lai, Taiwan (TW)

(73) Assignee: NIKE, Inc., Beaverton, OR (US)

( * ) Notice: Subject to any disclaimer, the term of this patent is extended or adjusted under 35 U.S.C. 154(b) by 23 days.

(21) Appl. No.: 17/636,625

(22) PCT Filed: Aug. 28, 2019

(86) PCT No.: PCT/CN2019/102973
§ 371 (c)(1),
(2) Date: Feb. 18, 2022

(87) PCT Pub. No.: WO2021/035563
PCT Pub. Date: Mar. 4, 2021

(65) Prior Publication Data

US 2022/0282409 A1 Sep. 8, 2022

(51) Int. Cl.
*D04B 1/12* (2006.01)

(52) U.S. Cl.
CPC ..... *D04B 1/123* (2013.01); *D04B 1/126* (2013.01); *D10B 2201/02* (2013.01); *D10B 2403/0114* (2013.01); *D10B 2403/023* (2013.01)

(58) Field of Classification Search
CPC ..... D04B 1/123; D04B 1/126; D04B 7/14; D04B 9/16
See application file for complete search history.

(56) References Cited

U.S. PATENT DOCUMENTS 3,964,277 A 6/1976 Miles
3,986,374 A * 10/1976 Fane ..... D04B 9/06 66/190

(Continued)

FOREIGN PATENT DOCUMENTS

BE 1022320 B1 3/2016
CN 1355863 A 6/2002

(Continued)

OTHER PUBLICATIONS

International Search Report issued in PCT/CN2019/102973, issued Mar. 4, 2021, 5 pages.

(Continued)

*Primary Examiner* — Danny Worrell
(74) *Attorney, Agent, or Firm* — Shook, Hardy & Bacon L.L.P.

(57) ABSTRACT

Disclosed is a double-knit textile having a plurality of texturized inlay yarns movably positioned between a front layer (112) and a back layer (114) of the double-knit textile. The double-knit textile includes areas where a yarn from the back layer is transferred to the front layer and knitted in one or more knit stitches to form an interknitted location (116). The number of interknitted locations per unit area varies in different portions of the double-knit textile. The double-knit textile is configured to provide zoned insulation and/or cushioning features.

19 Claims, 4 Drawing Sheets

(56) References Cited

U.S. PATENT DOCUMENTS

| | | | | | |
|---|---|---|---|---|---|
| 3,990,268 | A * | 11/1976 | Smith | D04B 15/80 | 66/9 R |
| 4,043,152 | A | 8/1977 | Bryars | | |
| 4,125,001 | A | 11/1978 | Bryars | | |
| 4,144,727 | A | 3/1979 | Duhl et al. | | |
| 4,212,174 | A | 7/1980 | Shepherd | | |
| 4,244,197 | A | 1/1981 | Althammer | | |
| 4,244,198 | A | 1/1981 | Schaab et al. | | |
| RE30,638 | E | 6/1981 | Bryars | | |
| 4,353,229 | A | 10/1982 | Hutchinson et al. | | |
| 5,027,618 | A * | 7/1991 | Robinson | D04B 1/22 | 66/195 |
| 5,299,435 | A * | 4/1994 | Whalley | D04B 1/123 | 66/61 |
| 6,622,528 | B2 * | 9/2003 | Masse | D04B 9/28 | 66/196 |
| 7,395,681 | B2 | 7/2008 | Oya et al. | | |
| 7,437,895 | B2 | 10/2008 | Okuno | | |
| 7,611,999 | B2 | 11/2009 | Mcmurray | | |
| 9,803,299 | B2 | 10/2017 | Podhajny | | |
| 10,172,422 | B2 | 1/2019 | Podhajny et al. | | |
| 10,174,445 | B2 * | 1/2019 | Brunton | D04B 1/123 | |
| 10,626,529 | B2 * | 4/2020 | Brunton | D04B 9/38 | |
| 10,912,340 | B2 * | 2/2021 | Diaz | D04B 1/246 | |
| 2003/0106346 | A1 | 6/2003 | Matsumoto | | |
| 2008/0236204 | A1 * | 10/2008 | Vanwelden | D04B 9/28 | 66/170 |
| 2015/0075227 | A1 | 3/2015 | Tsujigo et al. | | |
| 2016/0353810 | A1 | 12/2016 | Bames et al. | | |
| 2017/0130376 | A1 * | 5/2017 | Brunton | D04B 1/123 | |
| 2017/0362751 | A1 | 12/2017 | Vanwelden | | |
| 2018/0100254 | A1 * | 4/2018 | Brunton | D04B 9/16 | |
| 2019/0226128 | A1 | 7/2019 | Cox et al. | | |
| 2019/0336350 | A1 * | 11/2019 | Alós Villacrosa | D04B 1/225 | |
| 2019/0374480 | A1 * | 12/2019 | Patel | D06M 16/00 | |
| 2022/0282409 | A1 * | 9/2022 | Hendry | D04B 1/123 | |

FOREIGN PATENT DOCUMENTS

| | | | | |
|---|---|---|---|---|
| CN | 2642801 | | 9/2004 | |
| CN | 101736515 | A | 6/2010 | |
| CN | 101876120 | A | 11/2010 | |
| CN | 103334213 | A | 10/2013 | |
| CN | 104099713 | B | 3/2016 | |
| CN | 104264352 | B | 5/2016 | |
| CN | 205398890 | | 7/2016 | |
| CN | 205398891 | | 7/2016 | |
| CN | 105926144 | | 9/2016 | |
| CN | 108570755 | A | 9/2018 | |
| CN | 108588990 | A | 9/2018 | |
| CN | 109137241 | A | 1/2019 | |
| GB | 1577399 | A | 10/1980 | |
| GB | 2233989 | A * | 1/1991 | D04B 1/123 |
| JP | 2015-151645 | A | 8/2015 | |
| WO | 9111122 | | 8/1991 | |
| WO | 02/00980 | A1 | 1/2002 | |
| WO | 2019143501 | A1 | 7/2019 | |

OTHER PUBLICATIONS

Doublejersey Inlay, Jo Ann's Knitting Blog, Practical Guide, Available online at: <http://knittingmagic.biz/>, Apr. 18, 2019, 4 pages.

International Preliminary Report on Patentability received for PCT Patent Application No. PCT/CN2019/102973, mailed on Mar. 10, 2022, 6 pages.

Jogging Pants in Double-sided Jacquard With Mesh-effect Design, Giorgio Armani, Available online at: <armani.com>, Accessed on May 2019, 3 pages.

Margot—Avorio/Reversible, Rubelli Textiles, 30314-001, Available online at: <rubelli.com>,, Accessed on May 2019, 2 bages.

Ališauskienē et al., "Influence of Inlay-Yarn Properties and Insertion Density on the Compression Properties of Knitted Orthopaedic Supports", Fibres and Textiles in Eastern Europe, vol. 21, No. 6(102), Nov. 2013, pp. 8-12.

Extended European Search Report received for European Patent Application No. 19943847.4, mailed on May 22, 2023, 10 pages.

* cited by examiner

DOUBLE-KNIT TEXTILE WITH TEXTURIZED INLAY YARNS

This application titled "Double-Knit Textile with Texturized Inlay Yarns," is a 35 U.S.C. 371 application of PCT Application No. PCT/CN2019/102973, filed Aug. 28, 2019, and titled "Double-Knit Textile with Texturized Inlay Yarns."

TECHNICAL FIELD

Aspects herein are directed to a double-knit textile with texturized inlay yarns positioned between the two layers of the double-knit textile.

BACKGROUND

Inlay yarns associated with traditional double-knit textiles are generally anchored by integrally knitting the inlay yarn with yarns from the front layer or the back layer of the double-knit textile. This may cause the inlay yarn to be exposed on the surface of the front or back layer. As well, traditional double-knit textiles having inlay fibers or filaments or non-texturized inlay yarns may have problems with the fibers or filaments migrating through the front or back layers which decreases the aesthetic appeal of the textile.

BRIEF DESCRIPTION OF THE DRAWINGS

Examples of aspects herein are described in detail below with reference to the attached drawings figures, wherein.

DETAILED DESCRIPTION

Figure 1A:
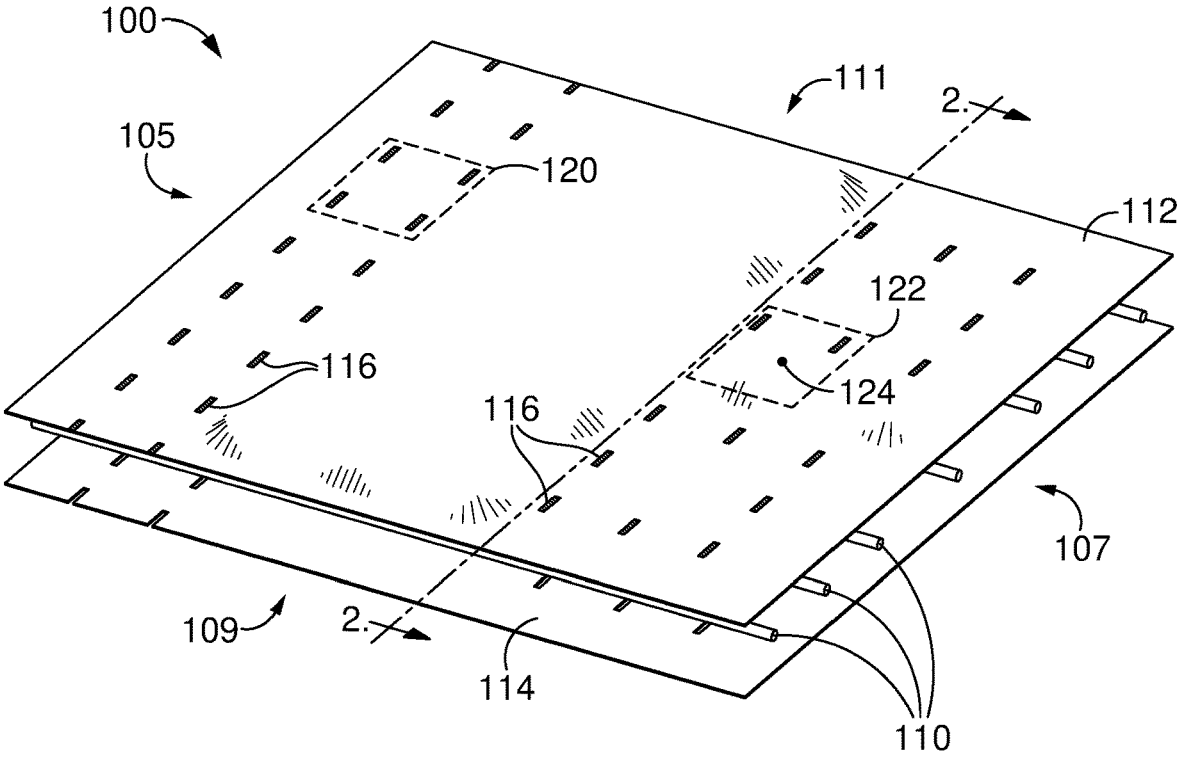
FIG. 1A illustrates a top perspective, schematic depiction of a double-knit textile having texturized inlay yarns in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional double-knit textiles having inlay yarns or inlay fibers/filaments generally face problems with the inlay yarns showing through on the front or back layers due to integrally knitting the inlay yarn with yarns from the front layer or the back layer to secure the yarn. As well, traditional double-knit textiles having inlay fibers/filaments or non-texturized inlay yarns may also have problems with the fibers/filaments migrating through the surfaces of the front or back layers. Both of these problems may create an undesirable aesthetic appeal. Aspects herein provide for a double-knit textile having texturized inlay yarns positioned between the front and back layers of the double-knit textile. Use of texturized inlay yarns, as opposed to loose fibers/filaments or non-texturized yarns, reduces migration of the fibers/filaments forming the yarns through the surfaces of the front and back layers. And instead of anchoring the texturized inlay yarns by integrally knitting the inlay yarns with yarns from the front or back layers, the double-knit textile includes two or more locations where a yarn from the back layer is transferred to the front layer, and the texturized inlay yarns are movably positioned between adjacent transfer locations thus preventing the inlay yarns from showing through on the surfaces of the double-knit textile.

As such, at a high level, aspects herein are directed to a double-knit textile having a front layer, a back layer, and a plurality of texturized inlay yarns positioned between the front and back layers. In example aspects, the double-knit textile may include two or more locations where a yarn from the back layer is transferred to the front layer to form, for example, interknitted locations. The texturized inlay yarns are located between adjacent interknitted locations and are moveable relative to one or more of the front layer and the back, layer in a direction of their longitudinal length. In other words, the texturized inlay yarns are floating between adjacent interknitted locations and are not integrally knitted with yarns from the front or back layers. The use of the interknitted locations to maintain the inlay yarns in position prevents the inlay yarns from drifting or settling due to gravity. Use of this construction instead of, for instance, integrally knitting the inlay yarns with yarns from the front layer or the back layer, also prevents the inlay yarns from showing through on the surfaces of the front and back layers.

As stated above, use of a texturized inlay yarn, as opposed to loose fiber or filament inlays and/or a non-texturized inlay yarn, helps to reduce migration of the fibers or filaments through the surfaces of the front and back layers. This is because the texturizing process entangles and twists the filaments forming the yarn helping to create a cohesive yarn structure and making it less likely that the filaments forming the yarn will separate from the yarn and migrate through the surfaces of the front or back layers. Migration may be further reduced by selecting a larger diameter yarn for at least the front layer and adjusting the yarn tension on the knitting machine to create a tight knit structure with low porosity. This may also be done for the back layer.

Aspects herein further contemplate varying the number of interknitted locations per unit area at different portions of the double-knit textile. Areas with fewer interknitted locations per unit area may have greater loft due less securement areas for the texturized inlay yarns, while areas with more interknitted locations per unit area may have less loft. The ability to create more or less loft by varying the number of interknitted locations per unit area may allow for the creation of zoned insulation or cushioning features in an article of apparel incorporating the double-knit textile. Aspects herein additionally contemplate creating a visual aesthetic by forming the front and back layers of the double-knit textile with yarns having differing visual properties such as color. At areas where yarns from the back layer are transferred to the front layer, the different color of the yarns from the back layer are visible when viewing the front layer. This, combined with varying the number of interknitted locations per unit area, can provide a visual marker as to areas of the double-knit textile having greater loft versus less loft.

As used herein, the term "double-knit textile" means a textile knit on a machine with two sets of needles in two needle beds or cylinders. Aspects herein contemplate the machine comprising a circular knit machine and/or a weft knit (flat knit) machine. The term "bed" typically is typically used when describing flat knit machines, and the term "cylinder" is typically used when describing circular knit machines. As used herein, the term "bed" is meant to encompass both flat knit machines and circular knit machines. To describe a double-knit textile in a different way, the term double-knit textile means a textile having courses of interlooped stitches forming a front layer or front side of the textile and courses of interlooped stitches forming a back layer or back side of the textile.

The term "transfer" as used herein means that a yarn being knitted on a back needle bed is transferred to a needle on a front needle bed. Once transferred, the yarn may be knit in one or more interlooped knit stitches of one or more knit courses before, for instance, being transferred back to the back needle bed. The term transfer may also mean that a yarn being knitted on a front needle bed is transferred to a needle on a back needle bed. Once transferred, the yarn may be knit in one or more interlooped knit stitches of one or more knit courses before, for instance, being transferred back to the front needle bed. Any and all aspects, and any variation thereof, are contemplated as being within aspects herein.

The term "yarn" as used herein means an assemblage of fibers or filaments that are twisted or laid together to form a continuous strand. The term "texturized inlay yarn" as used herein means a yarn having filaments, such as polyester filaments, that are entangled through, for example, air jetting as the filaments are being extruded. The air jetting creates entanglement "nodes" where the individual filaments are entangled with each other. The speed at which the yarn moves through the air jets determines the degree of entanglement. The degree of entanglement or texturizing may be measured by such metrics as the average entanglement length for each entanglement node measured over a 10 meter yarn distance, the distribution of entanglement nodes per meter which measures the average number of entanglement nodes per meter of yarn length, and the maximum entanglement node skip length which is the maximum unentangled length of yarn over a 10 meter length. The term "texturized inlay yarn" may additionally mean that the entangled yarn is twisted after the yarn is formed but prior to knitting. The twisted yarn may also be heat set prior to or after knitting the textile.

The term "integrally knit" as used herein may mean a knit textile having a yarn from one or more knitted courses in a first area being interlooped with one or more knitted courses of another area. The interlooping may be through a simple knit stitch, a tuck stitch, a held stitch, a float or miss stitch, and the like.

The term "visual property" as used herein may refer to different characteristic of the yarns used to form the double-knit textile described herein including differences in texture, denier, shine, color, and the like. With respect to the term "color," the term generally relates to a color of a material that may be afforded by dyes and/or colorants. Moreover, the term "color" when describing, for example, a yarn means an observable color of fibers/filaments that form the yarn. Such aspects contemplate that a color may be any color that may be afforded to a yarn using dyes, pigments, and/or colorants that are known in the art. As such, a yarn may be configured to have a color including, but not limited to red, orange, yellow, green, blue, indigo, violet, white, black, and shades thereof.

Aspects related to a color further contemplate determining if one color is different from another color. In these aspects, a color may comprise a numerical color value, which may be determined by using instruments that objectively measure and/or calculate color values of a color of an object by standardizing and/or quantifying factors that may affect a perception of a color. Such instruments include, but are not limited to spectroradiometers, spectrophotometers, and the like. Thus, aspects herein contemplate that a "color" of a yarn, a portion of the yarn may comprise a numerical color value that is measured and/or calculated using spectroradiometers and/or spectrophotometers. Moreover, numerical color values may be associated with a color space or color model, which is a specific organization of colors that provides color representations for numerical color values, and thus, each numerical color value corresponds to a singular color represented in the color space or color model.

In these aspects, a color may be determined to be different from another color if a numerical color value of each color differs. Such a determination may be made by measuring and/or calculating a numerical color value of, for instance, a portion of the double-knit textile having a first color with a spectroradiometer or a spectrophotometer, measuring and/or calculating a numerical color value of a different portion of the double-knit textile having a second color with the same instrument (i.e., if a spectrophotometer was used to measure the numerical color value of the first color, then a spectrophotometer is used to measure the numerical color value of the second color), and comparing the numerical color value of the first color with the numerical color value of the second color. If the numerical color values are not equal, then the first color is different than the second color, and vice versa.

Further, it is also contemplated that a visual distinction between two colors may correlate with a percentage difference between the numerical color values of the first color and the second color, and the visual distinction will be greater as the percentage difference between the color values increases. Moreover, a visual distinction may be based on a comparison between colors representations of the color values in a color space or model. For instance, when a first color has a numerical color value that corresponds to a represented color that is black or navy and a second color has a numerical color value that corresponds to a represented color that is red or yellow, a visual distinction between the first color and the second color is greater than a visual distinction between a first color with a represented color that is red and a second color with a represented color that is yellow.

FIG. 1A is a top perspective, schematic depiction of a double-knit textile 100 having a plurality of texturized inlay yarns 110 in accordance with aspects herein. The double-knit textile 100 includes a front layer 112 and a back layer 114, where the plurality of texturized inlay yarns 110 are positioned between the front layer 112 and the back layer 114. The knit courses forming the front layer 112 and the back layer 114 extend from a first side 105 to a second side 107 of the double-knit textile 100, and the wales of the front layer 112 and the back layer 114 extend from a third side 109 to a fourth side 111 of the double-knit textile 100.

In example aspects, the front layer 112 may be formed from a cotton yarn. More specifically, the front layer 112 may be formed from a single ply spun cotton yarn having a diameter from about 26 microns to about 35 microns, from about 27 microns to about 33 microns, from about 28 microns to about 32 microns, or about 32 microns. As used herein, the term "about" means ±10% of a designated value. Use of spun cotton imparts a soft hand to the double-knit textile 100 and provides a matte visual. It is contemplated herein that when the double-knit textile 100 is incorporated into an article of apparel, the front layer 112 forms an exterior-facing surface of the article of apparel. In example aspects, the cotton yarn may be undyed when knitted to form the front layer 112 of the double-knit textile 100 and then later dyed as outlined below. It is also contemplated herein that the cotton yarn may be dyed before the yarn is used to knit the double-knit textile 100.

Selection of a cotton yarn having a diameter in the disclosed range may allow for tight stitches to be knit when forming the front layer 112. As well, the tension on the yarn may be increased to further ensure that the spaces between the knit stitches are minimized and the overall porosity of the front layer 112 is reduced. Moreover, heat and time settings may be adjusted when finishing the double-knit textile 100 and/or articles of apparel made therefrom to further reduce porosity of the front layer 112. Reducing the porosity of the front layer 112 helps to minimize migration of fibers or filaments from inlay yarns through the front layer 112.

In one example aspect, the back layer 114 may be formed from a polyester yarn. More specifically, the back layer 114 may be formed from an air-jet texturized polyester yarn having a denier from about 80 denier to about 120 denier, from about 90 denier to about 110 denier, from about 95 denier to about 105 denier, or about 100 denier. The air-jet texturized polyester yarn may further comprise from about 80 filaments to about 120 filaments, from about 90 filaments to about 110 filaments, from about 95 filaments to about 105 filaments, or about 96 filaments. When the double-knit textile 100 is incorporated into an article of apparel, the back layer 114 may be positioned adjacent to a body surface of a wearer. Use of polyester yarns, with their low moisture regain, may facilitate the removal of moisture away from the body surface of the wearer by, for instance, capillary action between the filaments of the polyester yarn and/or between the individual polyester yarns.

In some aspects, the polyester yarn may comprise a regular polyester yarn, a cationic-dyeable polyester yarn, and/or a space-dyed polyester yarn. For instance, the back layer 114 may comprise 100% regular polyester yarn, a combination of cationic-dyeable polyester yarns and regular polyester yarns, a combination of space-dyed polyester yarns and regular polyester yarns, or a combination of cationic-dyeable polyester yarns and space-dyed polyester yarns. Any and all aspects, and any variation thereof, are contemplated as being within aspects herein. In example aspects, the regular polyester yarns and the cationic-dyeable polyester yarns may be undyed when knit to form the back layer 114 of the double-knit textile 100 and then later dyed as outlined below. It is also contemplated herein that the regular polyester yarns and the cationic-dyeable polyester yarns may be dyed before using the yarns to knit the double-knit textile 100.

As shown in FIG. 1A, the plurality of texturized inlay yarns 110 are positioned between opposing surfaces of the front layer 112 and the back layer 114. The depiction of the texturized inlay yarns 110 is illustrative only and, in reality, the plurality of texturized inlay yarns 110 would have greater texture as explained below with reference to FIG. 3. Moreover, only a discrete number of texturized inlay yarns 110 are shown for illustrative purposes, and it is contemplated herein that the double-knit textile 100 may include a greater number or a fewer number of texturized inlay yarns 110 than that shown. For instance, there may be about 5 to about 40 texturized inlay yarns 110 per centimeter as measured along the first side 105 or the second side 107 of the double-knit textile 100, from about 10 to about 30 texturized inlay yarns per centimeter, or from about 15 to 20 texturized inlay yarns per centimeter. In example aspects, the longitudinal length of the plurality of texturized inlay yarns 110 is oriented parallel to the courses forming the front layer 112 and the back layer 114 of the double-knit textile 100 and is oriented generally perpendicular to the wales of the double-knit textile 100. To state this differently, the plurality of texturized inlay yarns 110 extend from the first side 105 to the second side 107 of the double-knit textile 100.

Figure 3:
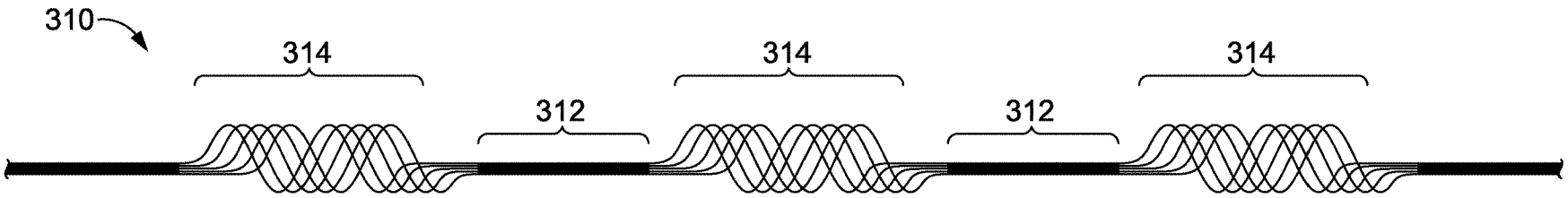
FIG. 3 illustrates a detail view of a texturized inlay yarn in accordance with aspects herein.

FIG. 3 depicts a more detailed view of one of the plurality of texturized inlay yarns 110 (labeled as texturized yarn 310). In example aspects, the texturized yarn 310 may comprise a polyester yarn having a denier from about 400 denier to about 800 denier, from about 500 denier to about 700 denier, from about 550 denier to about 650 denier, or about 600 denier. The texturized yarn 310 may have from about 100 filaments to about 300 filaments, from about 150 filaments to about 250 filaments, from about 175 filaments to about 225 filaments, or about 195 filaments. Again, use of polyester yarns as inlay yarns may facilitate the movement of moisture away from a wearer's body surface by way of capillary action when the double-knit textile 100 is formed into an article of apparel and the back layer 114 is positioned adjacent to the body surface of the wearer.

The texturized yarn 310 is formed by extruding polyester filaments from spinnerets and subjecting the filaments to one or more air jets while they are being extruded. The air jet(s) causes the filaments to become entangled with each other and/or to form loops within the individual filaments. The entanglement areas may be known as entanglement nodes and are referenced in FIG. 3 by the numeral 312. The speed at which the extruded filaments move through the air jet chamber determines the number of entanglement nodes. After the texturized yarn 310 has been subjected to air jetting, the texturized yarn 310 is then twisted before being inlaid in the double-knit textile 100. The twisted areas of the texturized yarn 310 are indicated by the reference numeral 314. It is also contemplated herein that during the finishing of the double-knit textile 100 and/or articles made therefrom, the heat applied to the double-knit textile 100 may help to heat set the texturized yarn 310. For example, the time that the heat is applied to the double-knit textile 100 and/or articles made therefrom may be approximately doubled to heat set the texturized yarn 310 and prevent it from untwisting. After air-jetting and twisting, the texturized yarn 310 may have a cohesive, texturized structure which prevents the filaments forming the texturized yarn 310 from separating from the texturized yarn 310 and migrating through the front layer 112 or the back layer 114 of the double-knit textile 100.

It is contemplated herein that the twisted areas 314 of the texturized yarn 310 may comprise from about 130 turns per meter (turns/meter) to about 170 turns/meter, from about 140 turns/meter to about 160 turns/meters, from about 145 turns/meter to about 155 turns/meter, or about 150 turns/ meter. It is also contemplated herein, that the average entanglement length for each entanglement node 312 as measured over a 10 meter yarn distance is from about 2.0 mm to about 5.0 mm, from about 2.5 mm to about 4.5 mm, or about 3 mm. The average number of entanglement nodes 312 per meter yarn distance is from about 100 to about 150, from about 110 to about 140, from about 120 to about 135, or about 130. And the maximum length between adjacent entanglement nodes 312 is less than about 6.0 mm, less than about 5.0 mm, or less than about 4.0 mm.

Returning to FIG. 1A, each of the plurality of texturized inlay yarns 110 is located between areas where a yarn from the back layer 114 is transferred to the front layer 112 and knitted in one or more interlooped knit stitches before being transferred back to the back layer 114. Areas where a yarn from the back layer 114 is transferred to the front layer 112 and knitted in one or mom interlooped knit stitches before transferring back to the back layer 114 are known as interknitted locations and are shown with hatching and indicated by reference numeral 116 in FIG. 1A.

Figure 2:
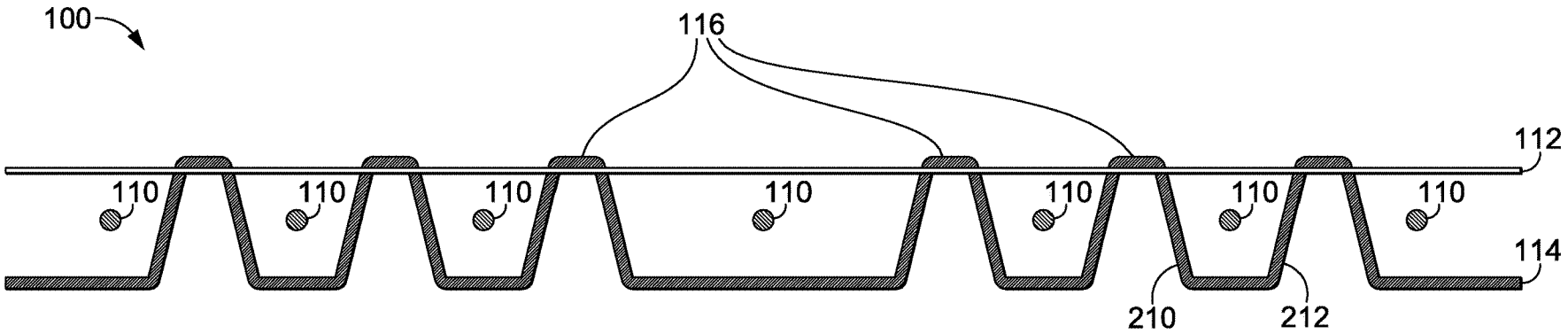
FIG. 2 illustrates a cross-section taken along cut line 2-2 of FIG. 1A to illustrate how the texturized inlay yarns are positioned between interknitted locations in accordance with aspects herein.

FIG. 2 depicts a cross-section of the double-knit textile 100 taken along cut line 2-2 of FIG. 1A and is used to schematically illustrate how the plurality of texturized inlay yarns 110 are located between the interknitted locations 116. As shown in the cross-section, the double-knit textile 100 includes the front layer 112 and the back layer 114. The back, layer 114 is shown with hatching. At periodic intervals, a yarn from the back layer 114 is transferred to the front layer 112 as indicated by reference numeral 210. After being transferred to the front layer 112, the yarn may be knit in one or more interlooped knit stitches to form an interknitted location 116 before being transferred back to the back layer 114 as indicated by reference numeral 212. The texturized inlay yarns 110 are located between adjacent interknitted locations 116. As shown, the texturized inlay yarns 110 are not integrally knitted with the yarns forming the front layer 112 or the back layer 114 but, instead, are generally floating within the space between the front layer 112 and the back layer 114. To describe this differently, each texturized inlay yarn 110 is generally movable relative to one or more of the front layer 112 and the back layer 114 in a direction of its longitudinal length. The interknitted locations 116 help to secure the texturized inlay yarns 110 by preventing the texturized inlay yarns 110 from drifting or settling due to, for instance, gravity. By not integrally knitting the texturized inlay yarns 110 with yarns from the front layer 112 or the back layer 114, the texturized inlay yarns 110 are prevented from showing through on the face of the double-knit textile 100 which may create a more desirable aesthetic for the double-knit textile 100.

Figure 1B:
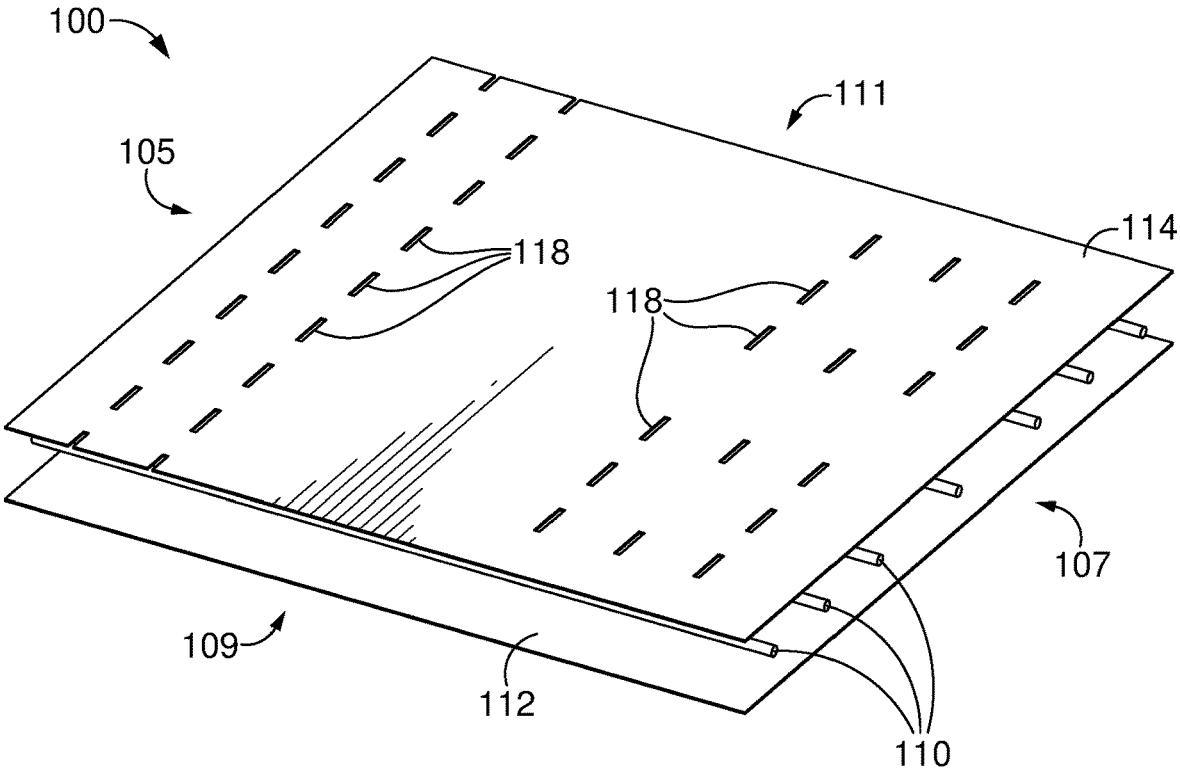
FIG. 1B illustrates a bottom perspective schematic depiction of the double-knit textile of FIG. 1A in accordance with aspects herein.

The interknitted locations 116 shown in FIG. 1A represent areas where yarns from the back layer 114 are transferred to the front layer 112 and knit in one or more interlooped knit stitches before being transferred back to the back layer 114. As shown in FIG. 1B, which represents a bottom perspective, schematic depiction of the double-knit textile 100 the areas where yarns from the back layer 114 are transferred to the front layer 112 may visually appear as missed stitch areas 118 since the yarn in the missed stitch areas 118 is physically removed from a back needle and transferred to a front needle. Accordingly, the pattern of the missed stitch areas 118 on the back layer 114 corresponds to the pattern of interknitted locations 116 on the front layer 112.

It is contemplated herein that the yarns from the back layer 114 may be knit in such a way as to be visible on the front layer 112 at the interknitted locations 116 (see, for example, FIG. 1A and FIG. 2). Further, the yarns from the back layer 114 may have a different visual property than the yarns used to knit the front layer 112. The visual property may comprise a texture, a luster, a size (e.g., diameter), a color, and the like. The hatching shown at the interknitted locations 116 represents the visual property associated with the yarns from the back layer 114. In one example aspect, the visual property may comprise a color, and the color of the yarn from the back layer 114 may comprise a different color from the yarns used to form the front layer 112. Use of a different color for the yarns from the back layer 114 that form the interknitted locations 116 provides a visual marker as to the location and/or concentration of the interknitted locations 116 on the double-knit textile 100.

As further shown in FIG. 1A, it is contemplated herein that different portions of the double-knit textile 100 may have varying numbers of interknitted locations 116 per unit area. That is, instead of the interknitted locations 116 being uniformly distributed across the front layer 112, there may be a greater number of interknitted locations in certain areas of the double-knit textile 100. For instance, first area 120 denoted by dashed lines and second area 122 denoted by dashed lines comprise the same surface area (e.g., a 1 cm×1 cm area) and integrally extend from each other. That is, yarns used to knit courses in the first area 120 are interlooped with yarns used to knit courses in the second area 122. As shown, there are four interknitted locations 116 in the first area 120 and two interknitted locations in the second area 122.

In example aspects, it follows that areas of the double-knit textile 100 having fewer interknitted locations 116 per unit area will have more open areas such as open area 124 (i.e., areas in which the front layer 112 and the back layer 114 are not interknitted). Due to the texture of the texturized inlay yarns 110, the open areas 124 have an increased amount of loft as compared to areas of the double-knit textile 100 having a greater number of interknitted locations 116 per unit area such as the first area 120. The amount of loft may further be increased in the open areas 124 by increasing the number of texturized inlay yarns 110 per centimeter. Conversely, the amount of loft may be decreased in the open areas 124 by decreasing the number of texturized inlay yarns 110 per centimeter.

Areas having fewer interknitted locations 116 per unit area and more loft such as the second area 122 may provide cushioning and/or insulation features to the double-knit textile 100. And areas having a greater number of interknitted locations 116 per unit area and less loft such as the first area 120 may provide less cushioning and/or insulation features. When the double-knit textile 100 is incorporated into an article of apparel, such as an upper-body garment, the areas with more loft may be positioned on the upper-body garment to correspond to, for instance, areas needing higher amounts of insulation such as the front of the upper-body garment and/or the sleeves of the upper-body garment. The areas with more loft may also be positioned on the upper-body garment to correspond to areas needing higher amounts of cushioning such as, for instance, the elbow area. Areas of the double-knit textile 100 with less loft may be positioned on the upper-body garment to correspond to areas with lower insulation needs such as the upper back of the upper-body garment.

As discussed above, the use of a different color for the yarns from the back layer 114 that form the interknitted locations 116 provides a visual marker as to the location and/or concentration of the interknitted locations 116 on the double-knit textile 100. Because the concentration of the interknitted locations 116 corresponds to areas of the double-knit textile 100 having increased loft or decreased loft, the use of a different color for the yarns from the back layer 114 that form the interknitted locations 116 may also provide a visual marker as to the location of areas of the double-knit textile 100 having increased loft and/or insulation/cushioning features. The pattern of the interknitted locations 116 shown in FIG. 1 is illustrative only, and it is contemplated herein that the interknitted locations 116 may form other patterns including, for example, logos, alphanumeric characters, organic shapes, curvilinear shapes, and the like. Any and all aspects, and any variation thereof, are contemplated as being within aspects herein.

Aspects herein contemplate knitting the double-knit textile 100 utilizing un-dyed yarns. For instance, the cotton yarn may be un-dyed, the regular polyester yarn when used may be un-dyed, and the cationic-dyeable polyester yarn when used may be un-dyed. After the double-knit textile 100 is knit it then may be, for instance, cross-dyed with different dye substances that react with the different yarn types such that the front layer 112 comprises a first color and the back layer 114 comprises a second color different from the first color.

Figure 4:
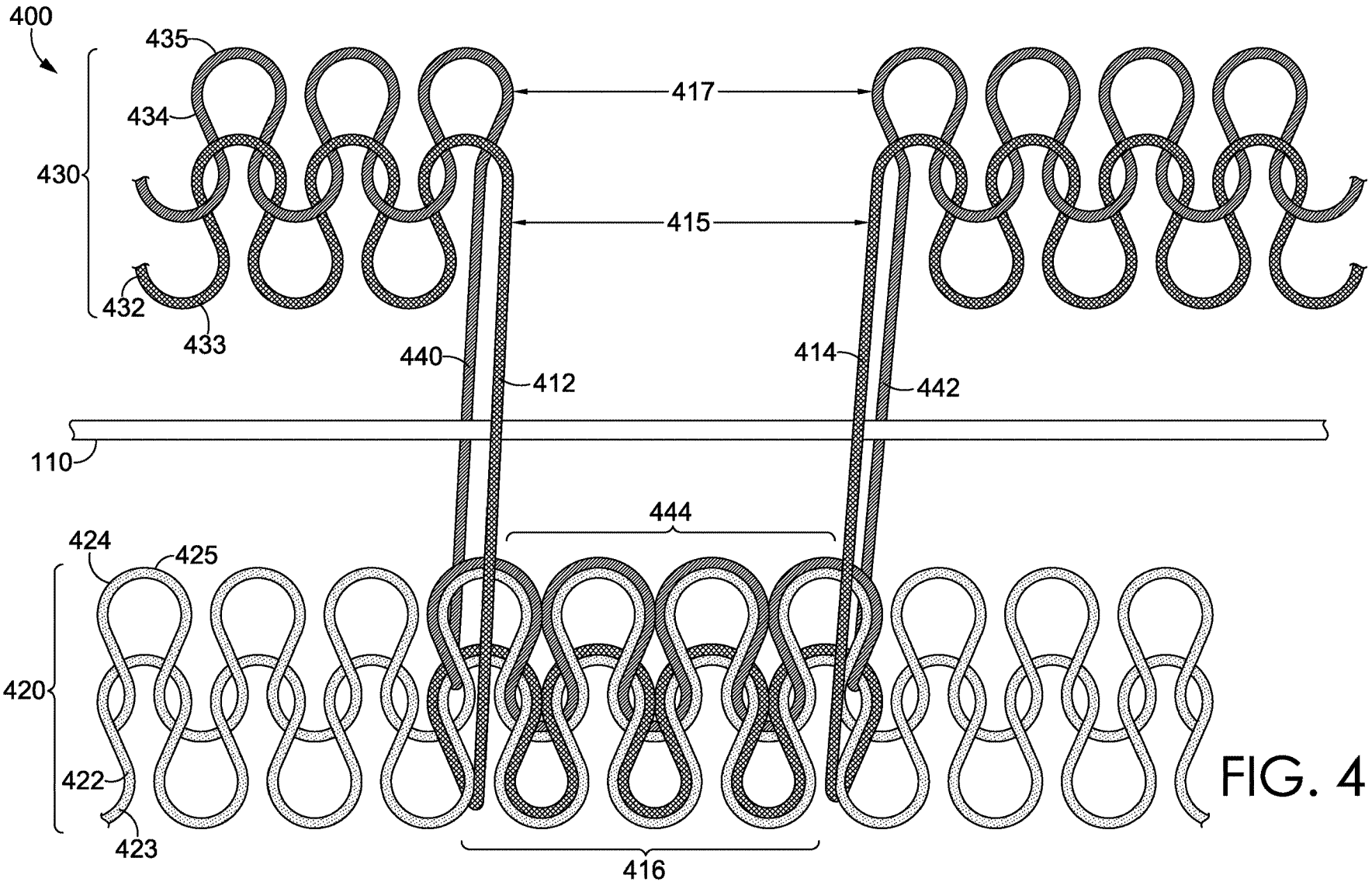
FIG. 4 illustrates an example knit structure of the double-knit textile of FIGS. 1A and 1B in accordance with aspects herein.

Turning now to FIG. 4, an example knit structure, referenced generally by the numeral 400 is provided in accordance with aspect % herein. The knit structure 400 represents example areas of the double-knit textile 100 where yarns from the back layer 114 are transferred to the front layer 112 to form the interknitted locations 116 and the texturized inlay yarns 110 are positioned between adjacent interknitted locations 116.

Front bed (or front cylinder) courses are indicated by reference numeral 420 and include course 422 and course 424. The course 422 may be knit with yarn 423 indicated with stippling, and the course 424 may be knit with yarn 425 indicated with stippling. It is contemplated herein that the yarn 423 and the yarn 425 may comprise the same yarn or they may comprise different yarns that are joined together to form a continuous strand. Back bed (or back cylinder) courses am indicated by reference numeral 430 and include course 432 and course 434. The course 432 may be knit with yarn 433 indicated with cross-hatching, and the course 434 may be knit with yarn 435 indicated by hatching. It is contemplated herein that the yarn 433 and the yarn 435 may comprise the same yarn or they may comprises different yarns that are joined together to form a continuous strand.

Continuing, in example aspects, the course 422 and the course 432 may be knit at substantially the same time on the knit machine. Subsequently, the course 424 and the course 434 may be knit at substantially the same time on the knit machine. For instance, when knit on a flat knit or weft knit machine with a front and back needle bed, the course 422 and the course 432 may be knit during one pass of the carriage, and the courses 424 and 434 may be knit during a returning pass of the carriage. When knit on a circular knit machine, the course 422 and the course 432 may be knit during one rotation of the cylinders, and the courses 424 and 434 may be knit during a second subsequent rotation of the cylinders. The insertion of one or more of the texturized inlay yarns 110 may occur after the courses 422 and 432 have been knit but before the courses 424 and 434 have been knit in example aspects.

During the knitting of the course 432, the yarn 433 may be transferred to the course 422 (e.g., transferred from the back to the front) as indicated by reference numeral 412. When transferred to the course 422, the yarn 433 may be in a plated relationship with the yarn 423 and be positioned so that it is exposed on the surface of the front layer 112 of the double-knit textile 100. The yarn 433, along with the yarn 423, may be knit in one or more interlooped knit stitches along the course 422 before the yarn 433 is transferred back to the course 432 (e.g., transferred from the front to the back) as indicated by reference numeral 414. Although shown as simple knit stitches, it is contemplated herein that the yarns 423 and 433 may form different knit stitches such as floats, tuck stitches, field stitches, and the like. This series of knitting steps forms a first interknitted location 416. After the yarn 433 is transferred to the course 422, the course 432 may comprise a series of missed stitches as indicated by reference numeral 415 before the yarn 433 is transferred back to the course 432. The missed stitch area 415 corresponds to one of the missed stitch areas 118 shown in FIG. 1B.

During the subsequent knitting of the course 434, the yarn 435 may be transferred to the course 424 (e.g., transferred from the back to the front) as indicated by reference numeral 440. When transferred to the course 424, the yarn 435 may be in a plated relationship with the yarn 425 and be positioned so that it is exposed on the surface of the front layer 112 of the double-knit textile 100. The yarn 435, along with the yarn 425, may be knit in one or more interlooped knit stitches along the course 424 before the yarn 435 is transferred back to the course 434 (e.g., transferred from the front to the back) as indicated by reference numeral 442. Although shown as simple knit stitches, it is contemplated herein that the yarns 425 and 435 may form different knit stitches such as floats, tuck stitches, held stitches, and the like. This series of knitting steps forms a second interknitted location 444. After the yarn 435 is transferred to the course 424, the course 434 may comprise a series of missed stitches as indicated by reference numeral 417 before the yarn 435 is transferred back to the course 434.

Although the first interknitted location 416 and the second interknitted location 444 are shown as being positioned at the same stitch locations along the courses 422, 424, 432, and 434, it is contemplated herein that the first interknitted location 416 may be positioned at different stitch locations than the second interknitted location 444. Moreover, although the yarn 433 and the yarn 435 are shown as forming four interlooped knit stitches in the respective courses 422 and 424, it is contemplated herein that the yarns 433 and 435 may form a fewer number or a greater number of knit stitches in the respective courses 422 and 424. In addition, it is also contemplated herein that yarns, such as yarns 423 and/or 425 from the front bed courses 420 may be transferred to the back bed courses 430. For example, the yarn 423 may be transferred to the course 432 and knit in one or more interlooped knit stitches before being transferred back to the course 422. And the yarn 425 may be transferred to the course 434 and knit in one or more interlooped knit stitches before being transferred back to the course 424. The interknitted locations caused by these transfers may be at the same stitch positions or different stitch positions than the first interknitted location 416 and the second interknitted location 444. Any and all aspects, and any variation thereof, are contemplated as being within aspects herein.

As mentioned above, it is contemplated herein that the texturized inlay yarn 110 is inlaid after the courses 422 and 432 are knit but before the courses 424 and 434 are knit. As such, the texturized inlay yarn 110 is positioned between the first interknitted location 416 and the second interknitted location 444. Its location between the first interknitted location 416 and the second interknitted location 444 helps to secure the texturized inlay yarn 110 and prevents, it from drifting or settling. Although only one texturized inlay yarn 110 is shown being positioned between the first interknitted location 416 and the second interknitted location 444, it is contemplated herein that more than one texturized inlay yarn 110 may be positioned between the first interknitted location 416 and the second interknitted location 444 (i.e., more than only texturized inlay yarn 110 may be laid in between the first interknitted location 416 and the second interknitted location 444). It is also contemplated herein, that there may be areas of the double-knit textile 100 in which the texturized inlay yarns 110 are not laid in between interknitted locations. This may occur in areas of the double-knit textile 100 where less loft is desired.

Figure 5:
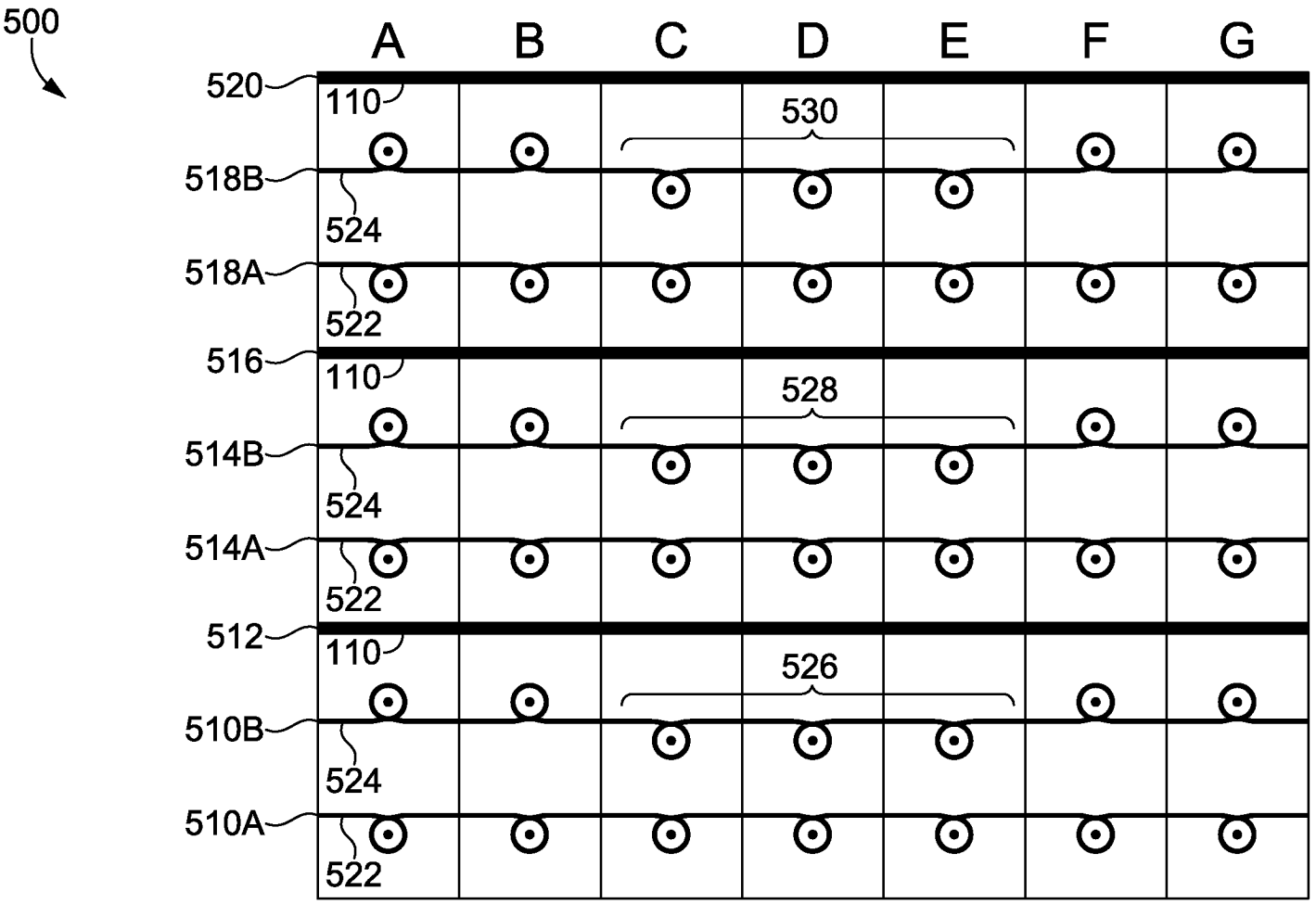
FIG. 5 illustrates an example knit program corresponding to the double-knit textile of FIGS. 1A and 1B in accordance with aspects herein.

Turning to FIG. 5, an example knit program diagram 500 corresponding to, for instance, areas of the double-knit textile of FIG. 1A and FIG. 1B is provided in accordance with aspects herein. The knit program diagram 500 designates a stitch type and a stitch location for each yarn represented by rows 510A-B, 512, 514A-B, 516, 518A-B. and 520 at seven stitch locations represented by columns A-G. Each of rows 510A. 514A, and 518A prescribe knit structures for a first yarn 522, and likewise, each of rows 510B. 514B, and 5188 prescribe knit structures for a second yarn 524. The rows 510A, 514A, and 518A prescribe seven stitches with the first yarn 522 on the front layer 112 of the double-knit textile 100, and the tows 510B. 514B, and 5181 prescribe seven stitches with the second yarn 524 on the back layer 114 of the double-knit textile 100. As such, the rows 510A. 514A, and 518A correspond with three front, layer 112 courses, and rows 510B. 514B, and 518B correspond with three back layer 114 courses. In example aspects, rows 510A and 510B would be substantially knit at the same time, rows 514A and 514B would be substantially knit at the same time, and rows 518A and 518B would be substantially knit at the same time.

Row 510A designates stitches for the first yarn 522 (in example, aspects, the first yarn 522 may generally correspond to yarn 423 in course 422 in FIG. 4). As shown, the row 510A designates seven stitches on the front layer 112. Row 510B designates stitches for the second yarn 524 (in example aspects, the second yarn 524 may generally correspond to yarn 433 in course 432 in FIG. 4). Row 510B designates two stitches on the back layer 114, a transfer to the front layer 112 in column C, three stitches on the front layer 112, a transfer back to the back layer 114 in column F. and two stitches on the back layer 114. The transfer to the front layer 112 in columns C-E forms a first interknitted location 526 which may generally correspond to, for instance the first interknitted location 416 in FIG. 4. As mentioned, rows 510A and 510B are knit at substantially the same time. After rows 510A and 510B are knit, the texturized inlay yarn 110 is laid in at 512.

Continuing, row 514A again designates stitches for the first yarn 522 (in example aspects, the first yarn 522 may generally correspond to the yarn 425 in course 424 in FIG. 4). Row 514B designates stitches for the second yarn 524 (in example aspects, the second yarn 524 may generally correspond to the yarn 435 in course 434 in FIG. 4). Row 514A designates seven stitches on the front layer 112. Row 514B designates two stitches on the back layer 114, a transfer to the front layer 112 in column C, three stitches on the front layer 112, a transfer back to the back layer 114 in column F. and two stitches on the back layer 114. The transfer to the front layer 112 in columns C-E forms a second interknitted location 528. The texturized inlay yarn 110 at 512 is secured between the first interknitted location 526 and the second interknitted location 528. As mentioned, rows 514A and 514B are knit at substantially the same time. After rows 514A and 514B are knit, the texturized inlay yarn 110 is laid in at 516.

This knitting sequence continues. For example, row 518A again designates stitches for the first yarn 522, and row 518B designates stitches for the second yarn 524. Row 518A designates seven stitches on the front layer 112. Row 518B designates two stitches on the back layer 114, a transfer to the front layer 112 in column C, three stitches on the front layer 112, a transfer back to the back layer 114 in column F. and two stitches on the back layer 114. The transfer to the front layer 112 in columns C-E forms a third interknitted location 530. The texturized inlay yarn 110 at 516 is secured between the second interknitted location 528 and the third interknitted location 530. After rows 518A and 518B are knit, the texturized inlay yarn 110 is laid in at 520. The above description is illustrative only and is meant to convey an example knit program that creates interknitted locations between the front and back layers of a double-knit textile and the inlaying of an inlay yarn.

Although the first, second, and third interknitted locations 526, 528, and 530 are each shown as being positioned at columns C-E, it is contemplated herein that the first, second, and third interknitted locations 526, 528, and 530 may each be located at different stitch locations (e.g., different columns), or that some of the interknitted locations may be aligned at the same stitch locations while other interknitted locations may be positioned at different stitch locations, it is also contemplated herein that the interknitted locations may span mom than three stitch locations or may span less than three stitch locations (e.g., the interknitted location may comprise just one stitch or two stitches). In addition, it is contemplated herein that more than one texturized inlay yarn 110 may be laid in at rows 512, 516, and 520 or that an inlay yarn may not be laid in at one of the rows 512, 516, or 520. Any and all aspects, and any variation thereof, are contemplated as being within aspects herein.

As discussed, it is contemplated herein that the double-knit textile 100 may be incorporated into various articles of apparel such as, for instance, upper-body garments, lower-body garments, outerwear (e.g., jackets and/or coats), hats, gloves, shoes (e.g., uppers), and the like. The ability to create zoned insulation and/or cushioning features by varying the concentration of interknitted locations across the double-knit textile 100 and/or by varying the number of texturized inlay yarns 110 that are inlaid, may be leveraged in an article of apparel based on, for instance, body heat maps and heat loss maps, body maps of pressure points, and the like. Moreover, the ability to visually map the interknitted locations by using a different color back yarn enables a prospective wearer to select an article of apparel that meets his or hers particular insulation/cushioning needs.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. A double-knit textile comprising:

a front layer;

a back layer, wherein a first yarn from the back layer is transferred to the front layer at a first interknitted location, and wherein a second yarn from the back layer is transferred to the front layer at a second interknitted location; and a plurality of texturized inlay yarns positioned between the front layer and the back layer, wherein at least a first texturized inlay yarn of the plurality of texturized inlay yarns is located between the first interknitted location and the second interknitted location, and wherein the first texturized inlay yarn is movable relative to at least the back layer in a direction of its longitudinal length.

Clause 2. The double-knit textile of clause 1, wherein the front layer is formed from a cotton yarn.

Clause 3. The double-knit textile of any of the preceding clauses, wherein the first texturized inlay yarn is not integrally knitted with the front layer or the back layer.

Clause 4. The double-knit textile of any of the preceding clauses, wherein the plurality of texturized inlay yarns are not integrally knitted with the front layer or the back layer.

Clause 5. The double-knit textile of any of the preceding clauses, wherein each texturized inlay yarn of the plurality of texturized inlay yarns comprises a 600 denier, 195 filament polyester yarn.

Clause 6. The double-knit textile of any of the preceding clauses, wherein each texturized inlay yarn of the plurality of texturized inlay yarns comprises about 150 turns/meter.

Clause 7. The double-knit textile of any of the preceding clauses, wherein each texturized inlay yarn of the plurality of texturized inlay yarns comprises an average entanglement length for each entanglement node of about 3.0 mm.

Clause 8. The double-knit textile of any of the preceding clauses, wherein each texturized inlay yarn of the plurality of texturized inlay yarns comprises an average number of entanglement nodes per meter of about 130.

Clause 9. The double-knit textile of any of the preceding clauses, wherein each texturized inlay yarn of the plurality of texturized inlay yarns comprises a maximum entanglement node skip length of less than about 4.0 mm.

Clause 10. A double-knit textile having a first area and a second area integrally extending from the first area, wherein the first area and the second area have a same surface area, the double-knit textile comprising:

a front layer;

a back layer, wherein one or more yarns from the back layer are transferred a first number of transfers to the front layer in the first area, and wherein one or more yarns from the back layer are transferred a second number of transfers to the front layer in the second area, wherein the first number of transfers is greater than the second number of transfers; and a plurality of inlay yarns positioned between the front layer and the back layer, wherein the plurality of inlay yarns are not integrally knitted with the front layer or the back layer at the first area or the second area.

Clause 11. The double-knit textile having the first area and the second area integrally extending from the first area of clause 10, wherein the front layer is formed from a cotton yarn.

Clause 12. The double-knit textile having the first area and the second area integrally extending from the first area of any of clauses 10 through 11, wherein at least a portion of the plurality of inlay yarns are movable relative to at least the back layer in a direction of their longitudinal length.

Clause 13. The double-knit textile having the first area and the second area integrally extending from the first area of any of clauses 10 through 12, wherein each inlay yarn of the plurality of inlay yarns comprises a 600 denier, 195 filament texturized yarn.

Clause 14. The double-knit textile having the first area and the second area integrally extending from the first area of any of clauses 10 through 13, wherein each inlay yarn of the plurality of inlay yarns comprises an average entanglement length for each entanglement node of about 3.0 mm, an average number of entanglement node, per meter of about 130, and a maximum entanglement node skip length of less than about 4.0 mm.

Clause 15. A double-knit textile comprising:

a front layer formed from a first yarn having a first visual property;

a back layer formed from a second yarn having a second visual property different from the first visual property, wherein the second yarn from the back layer is transferred to the front layer at least at a first interknitted location at a first area such that the second yarn with the second visual property is visible when viewing the front layer at the first area; and a plurality of inlay yarns positioned between the front layer and the back layer, wherein the plurality of inlay yarns are not integrally knitted with the front layer or the back layer at the first area.

Clause 16. The double-knit textile of clause 15, wherein the first visual property comprises a first color, and wherein the second visual property comprises a second color.

Clause 17. The double-knit textile of any of clauses 15 through 16, wherein at least a portion of the plurality of inlay yarns are movable relative to at least the back layer in a direction of their longitudinal length.

Clause 18. The double-knit textile of any of clauses 15 through 17, wherein each inlay yarn of the plurality of inlay yarns comprises a 600 denier, 195 filament texturized yarn.

Clause 19. The double-knit textile of any of clauses 15 through 18, wherein each inlay yarn of the plurality of inlay yarns comprises an average entanglement length for each entanglement node of about 3.0 mm, an average number of entanglement nodes per meter of about 130, and a maximum entanglement node skip length of less than about 4.0 mm.

Clause 20. The double-knit textile of any of clauses 15 through 19, wherein the front layer is formed from a cotton yarn.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A double-knit textile comprising:

a front layer;

a back layer, wherein a first yarn from the back layer is transferred to the front layer at a first interknitted location, and wherein a second yarn from the back layer is transferred to the front layer at a second interknitted location; and a plurality of texturized inlay yarns positioned between the front layer and the back layer, wherein at least a first texturized inlay yarn of the plurality of texturized inlay yarns is located between the first interknitted location and the second interknitted location, and wherein the first texturized inlay yarn is movable relative to at least the back layer in a direction of its longitudinal length; and wherein the first interknitted location and the second interknitted location comprise the first yarn and the second yarn in a plated relationship across multiple knit stitches.

2. The double-knit textile of claim 1, wherein the front layer is formed from a cotton yarn.

3. The double-knit textile of claim 1, wherein the first texturized inlay yarn is not interlooped with yarns from the front layer or the back layer.

4. The double-knit textile of claim 1, wherein the plurality of texturized inlay yarns are not interlooped with yarns from the front layer or the back layer.

5. The double-knit textile of claim 1, wherein each texturized inlay yarn of the plurality of texturized inlay yarns comprises a 600 denier, 195 filament polyester yarn.

6. The double-knit textile of claim 1, wherein each texturized inlay yarn of the plurality of texturized inlay yarns comprises about 150 turns/meter.

7. The double-knit textile of claim 1, wherein each texturized inlay yarn of the plurality of texturized inlay yarns comprises an average entanglement length for each entanglement node of about 3.0 mm.

8. The double-knit textile of claim 1, wherein each texturized inlay yarn of the plurality of texturized inlay yarns comprises an average number of entanglement nodes per meter of about 130.

9. The double-knit textile of claim 1, wherein each texturized inlay yarn of the plurality of texturized inlay yarns comprises a maximum entanglement node skip length of less than about 4.0 mm.

10. A double-knit textile having a first area and a second area integrally extending from the first area, wherein the first area and the second area have a same surface area, the double-knit textile comprising:

a front layer;

back layer, wherein one or more yarns from the back layer are transferred a first number of transfers to the front layer in the first area, and wherein one or more yarns from the back layer are transferred to a second number of transfers to the front layer in the second area, wherein the first number of transfers is greater than the second number of transfers; and a plurality of inlay yarns positioned between the front layer and the back layer, wherein the plurality of inlay yarns are not interlooped with yarns from the front layer or yarns from the back layer at the first area or the second area;

wherein the first interknitted location and the second interknitted location comprise yarns from the first layer and yarns from the second layer in a plated relationship across multiple knit stitches.

11. The double-knit textile of claim 10, wherein the front layer is formed from a cotton yarn.

12. The double-knit textile of claim 10, wherein the at least a portion of the plurality of inlay yarns are movable relative to at least the back layer in a direction of their longitudinal length.

13. The double-knit textile of claim 10, wherein each inlay yarn of the plurality of inlay yarns comprises a 600 denier, 195 filament texturized yarn.

14. The double-knit textile of claim 10, wherein each inlay yarn of the plurality of inlay yarns comprises an average entanglement length for each entanglement node of about 3.0 mm, an average number of entanglement nodes per meter of about 130, and a maximum entanglement node skip length of less than about 4.0 mm.

15. A double-knit textile comprising:

a front layer formed from a first yarn having a first visual property;

a back layer formed from a second yarn having a second visual property different from the first visual property, wherein the second yarn from the back layer is transferred to the front layer at least at a first interknitted location at a first area such that the second yarn with the second visual property is visible when viewing the front layer at first area; and a plurality of inlay yarns positioned between the front layer and the back layer, wherein the plurality of inlay yarns are not interlooped with yarns from the front layer or yarns from the back layer at the first area and at least a portion of the plurality of inlay yarns are movable relative to at least the back layer in a direction of their longitudinal length;

wherein the first interknitted location and the second interknitted location comprise the first yarn and the second yarn in a plated relationship across multiple knit stitches.

16. The double-knit textile of claim 15, wherein the first visual property comprises a first color, and wherein the second visual property comprises a second color.

17. The double-knit textile of claim 15, wherein each inlay yarn of the plurality of inlay yarns comprises a 600 denier, 195 filament texturized yarn.

18. The double-knit textile of claim 15, wherein each inlay yarn of the plurality of inlay yarns comprises an average entanglement length for each entanglement node of about 3.0 mm, an average number of entanglement nodes per meter of about 130, and a maximum entanglement node skip length of less than about 4.0 mm.

19. The double-knit textile of claim 15, wherein the front layer is formed from a cotton yarn.

* * * * *